United States Patent [19]

Schron

[11] Patent Number: 4,496,237

[45] Date of Patent: Jan. 29, 1985

[54] CONSUMABLE STATUS DISPLAY

[75] Inventor: Steven M. Schron, Fairport, N.Y.

[73] Assignee: Xerox Corporation, Stamford, Conn.

[21] Appl. No.: 406,652

[22] Filed: Aug. 9, 1982

[51] Int. Cl.[3] ..... G03G 15/00

[52] U.S. Cl. ..... 355/14 C; 364/550

[58] Field of Search ..... 355/14 C, 14 CU, 14 R, 355/3 R; 364/550, 551

[56] References Cited

U.S. PATENT DOCUMENTS

| | | | |
|---|---|---|---|
| 3,787,670 | 1/1974 | Nelson et al. | 235/153 |
| 3,813,157 | 5/1974 | Fantozzi | 355/14 |
| 3,893,175 | 7/1975 | Solomon | 360/6 |
| 4,030,072 | 6/1977 | Bjornsson | 340/172.5 |
| 4,133,477 | 1/1979 | Marino et al. | 235/304 |
| 4,194,833 | 3/1980 | Lester et al. | 355/14 CU |
| 4,266,294 | 5/1981 | Daughton et al. | 371/24 |
| 4,305,653 | 12/1981 | Evanitsky | 355/8 |
| 4,322,813 | 3/1982 | Howard et al. | 364/900 |

FOREIGN PATENT DOCUMENTS

| | | | |
|---|---|---|---|
| 2056133 | 3/1981 | United Kingdom | 364/550 |

*Primary Examiner*—A. T. Grimley
*Assistant Examiner*—David Warren
*Attorney, Agent, or Firm*—Ronald F. Chapuran

[57] ABSTRACT

The present invention is a reproduction machine having a non-volatile memory for storing indications of machine consumable usage such as photoreceptor, exposure lamp and developer, and an alphanumeric display for displaying indications of such usage. In operation, a menu of categories of machine components is first scrolled on the alphanumeric display. Scrolling is provided by repetitive actuation of a scrolling switch. Having selected a desired category of components to be monitored by appropriate keyboard entry, the subcomponents of the selected category can be scrolled on the display. In this manner, the status of various consumables can be monitored and appropriate instructions displayed for replacement. In another feature, the same information on the alphanumeric display can be remotely transmitted.

3 Claims, 6 Drawing Figures

96
ADDRESS
Ad/DATA
CHIP SELECT DECODE
94
88
INTR
RST 6.5
RST 7.5
RST 5.5
RDY
80a
80b
80c
82
ROM
ROM
ROM
RAM
CLK OUT
86
T. WAIT WRITE GEN
NSPW$_R$
RAM 2K NVM
84
CHIP SELECT
POWER NORMAL SENSE
NRSTin
TRAPin
85
90
MCB OUTPUTS
MCB INPUTS
92
98
RTC
WDT
BAUD 300
÷10
÷10
÷16
÷16
÷10
÷10
25 %
50 %

CONSUMABLE STATUS DISPLAY

This invention relates to a reproduction machine and, in particular, to a reproduction machine having the means to display the status of machine consumables for diagnostic purposes.

The art is replete with various diagnostic and display techniques. For example, U.S. Pat. No. 3,787,670, Automatic Diagnostic System, teaches the use of an anticipatory diagnostic system having a monitoring unit for observing operation of a peripheral device and for interrogating the monitoring unit and storing the output of the monitoring unit in a central processor. U.S. Pat. No. 4,030,072, Computer System Operation and Control, teaches the use of a control processor to initiate diagnostics stored within several of a data processing system devices.

It is also well known to provide diagnostic techniques for reproduction machines. In particular, U.S. Pat. No. 3,813,157, Control Logic for Trouble Detection and Recovery, teaches the use of control circuitry for detecting abnormal conditions such as paper supply out conditions and means for maintaining the integrity of counts of copies being made according to a differentiates billing schedule. U.S. Pat. No. 4,266,294, Copy Reproduction Machine with Controller Self Check System, describes the use of self check routines for determining the operational integrity of the machine prior to start up. U.S. Pat. No. 4,305,653, Scanning Diagnostics, teaches the use of determining scanning time periods and storing the time periods for diagnostics purposes and U.S. Pat. No. 3,893,175 describes an automatic recorder for monitoring selected components in a reproduction machine.

Other prior art systems disclose various status and fault code displays to assist operation or servicing of the machine. For example, U.S. Pat. No. 3,062,061 teaches the use of codes generally instructing an operator to perform specific corrective actions to clear the machine for operation. patent application Ser. No. 94,430, filed Oct. 30, 1979, First Fault Capture, teaches the capture and display of a first fault in a multifault situation and U.S. Ser. No. 323,783, filed Nov. 23, 1981, Directive Diagnostics, teaches the tracking of events in a reproduction machine in a sequential manner to determine the last successful event completed in a reproduction machine. In addition, U.S. Pat. No. 4,133,477, Fault Detection and System for Electrostatographic Machines, teaches the scanning of fault flag arrays for determining machine faults.

A difficulty, however, with prior art systems is that information is often not recorded on the usage of machine components or on the status of consumable components. In addition, even if recorded this information is often difficult to monitor or cannot be displayed or transmitted remotely.

It would be desirable, therefore, to record and be able to display the status of consumables or replaceable components in a reproduction machine. It would also be desirable to be able to have easy and rapid access to information on the usage of machine components. It would also be desirable to be able to display information that is easily obtained and interpreted by a casual machine operator and yet be able to transmit the same displayed information to a remote location if necessary. For example, it would be desirable to display an indication of usage of such components as the photoreceptor, developer materials, exposure lamp, cleaning blade, fuser rolls, and feed rolls, and to provide easily understood instructions for replacement.

It is an object of the present invention, therefore, to provide the means to record, display and transmit the status of selected machine components, in particular, the degree or rate of usage of consumables. It is also an object of the present invention to provide easy access to the information.

Further advantages of the present invention will become apparent as the following description proceeds and the features characterizing the invention will be pointed out with particularity in the claims next to and forming a part of this specification.

Briefly, the present invention is concerned with a reproduction machine having a non-volatile memory for storing indications of machine consumable usage and an alphanumeric display for displaying indications of such usage. In operation, a menu of categories of machine components is first scrolled on the alphanumeric display. Scrolling is provided by repetitive actuation of a scrolling switch. Having selected a desired category of components to be monitored by appropriate keyboard entry, the subcomponents of the selected category can be scrolled on the display by the repetitive actuation of the scrolling switch. In this manner, the status of various consumables can be monitored and appropriate instructions displayed for replacement. In another feature, the same information on the alphanumeric display can be remotely transmitted.

For a better understanding of the present invention reference may be had to the accompanying drawings wherein the same reference numerals have been applied to like parts and wherein.

Figure 1:
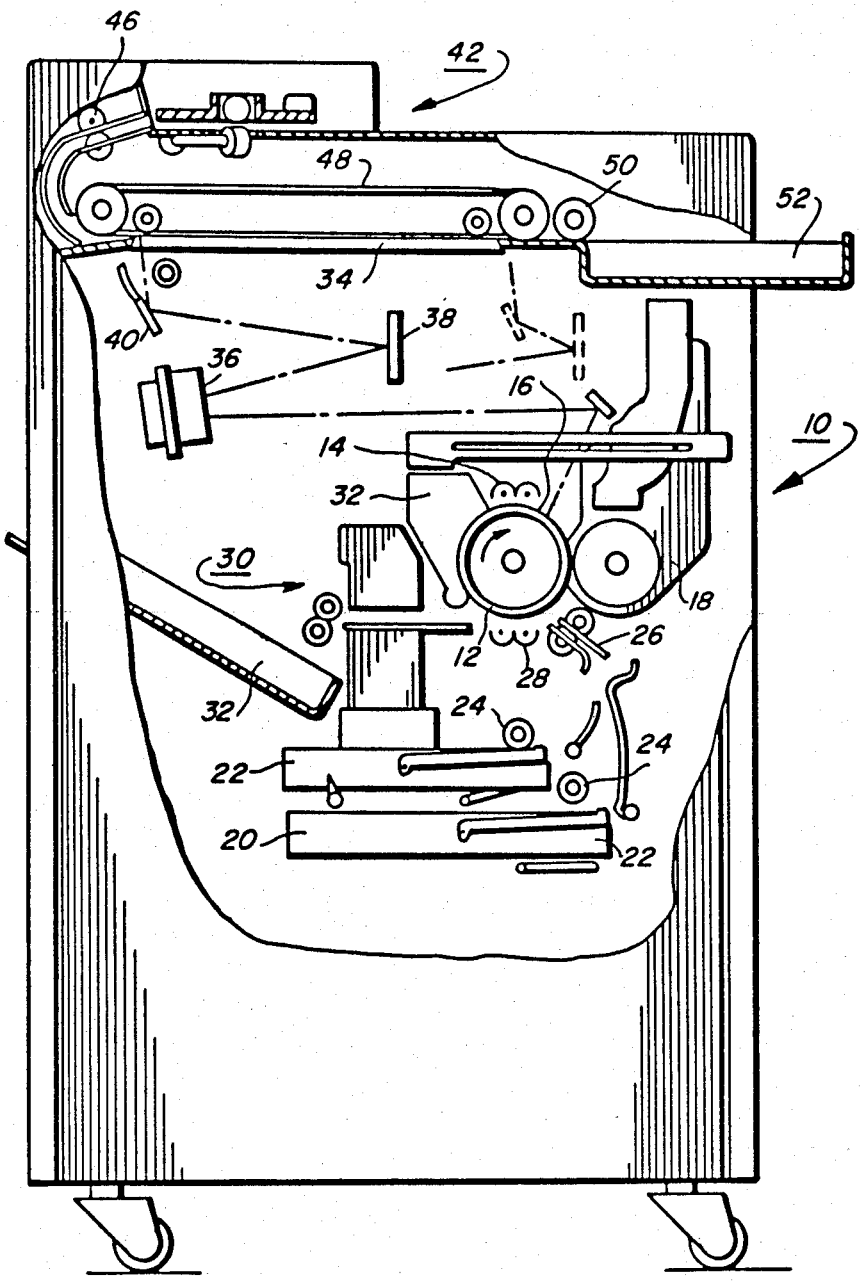
FIG. 1 is an elevational view of an electrophotographic machine employing the present invention.
Figure 5A:
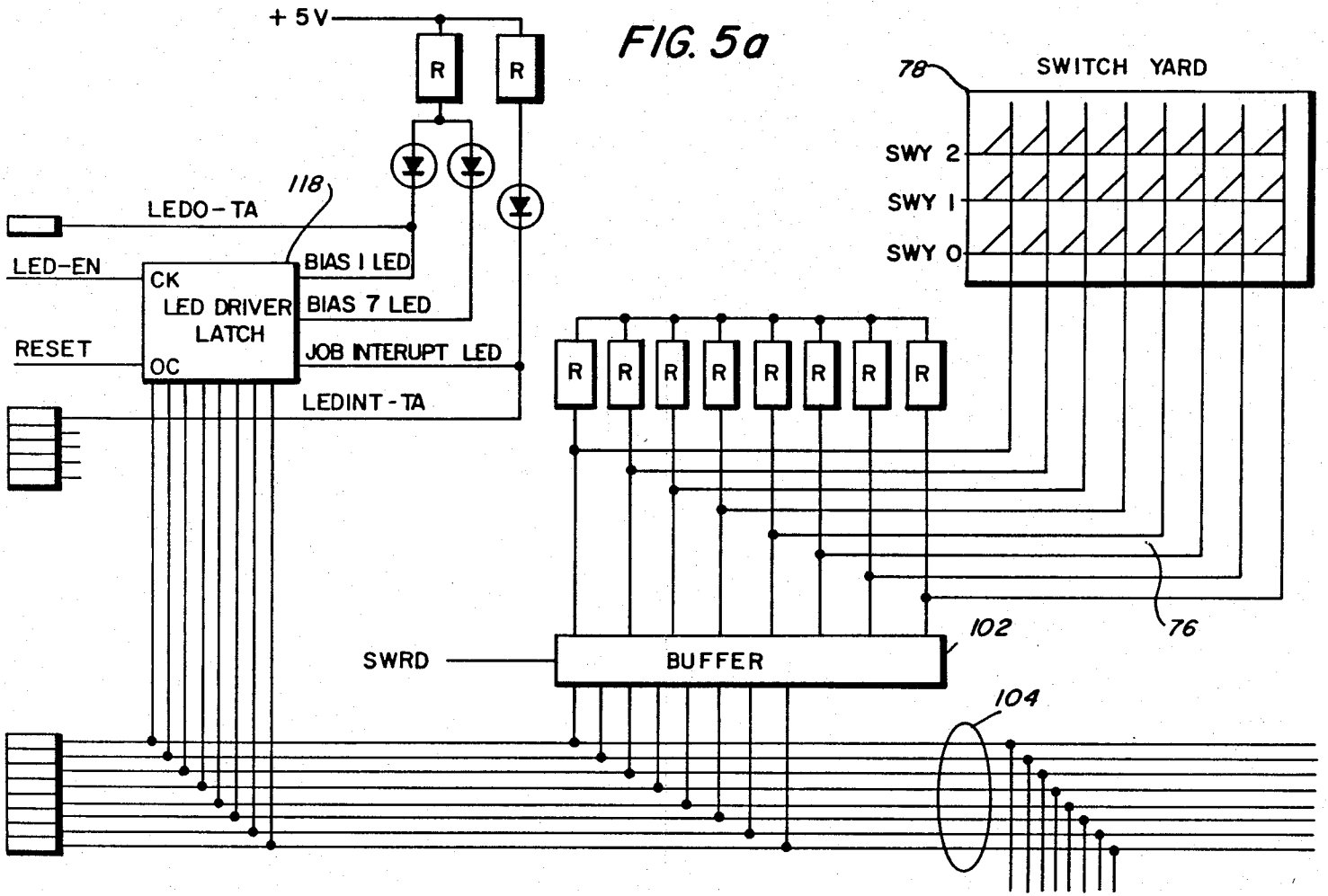
Figure 5B:
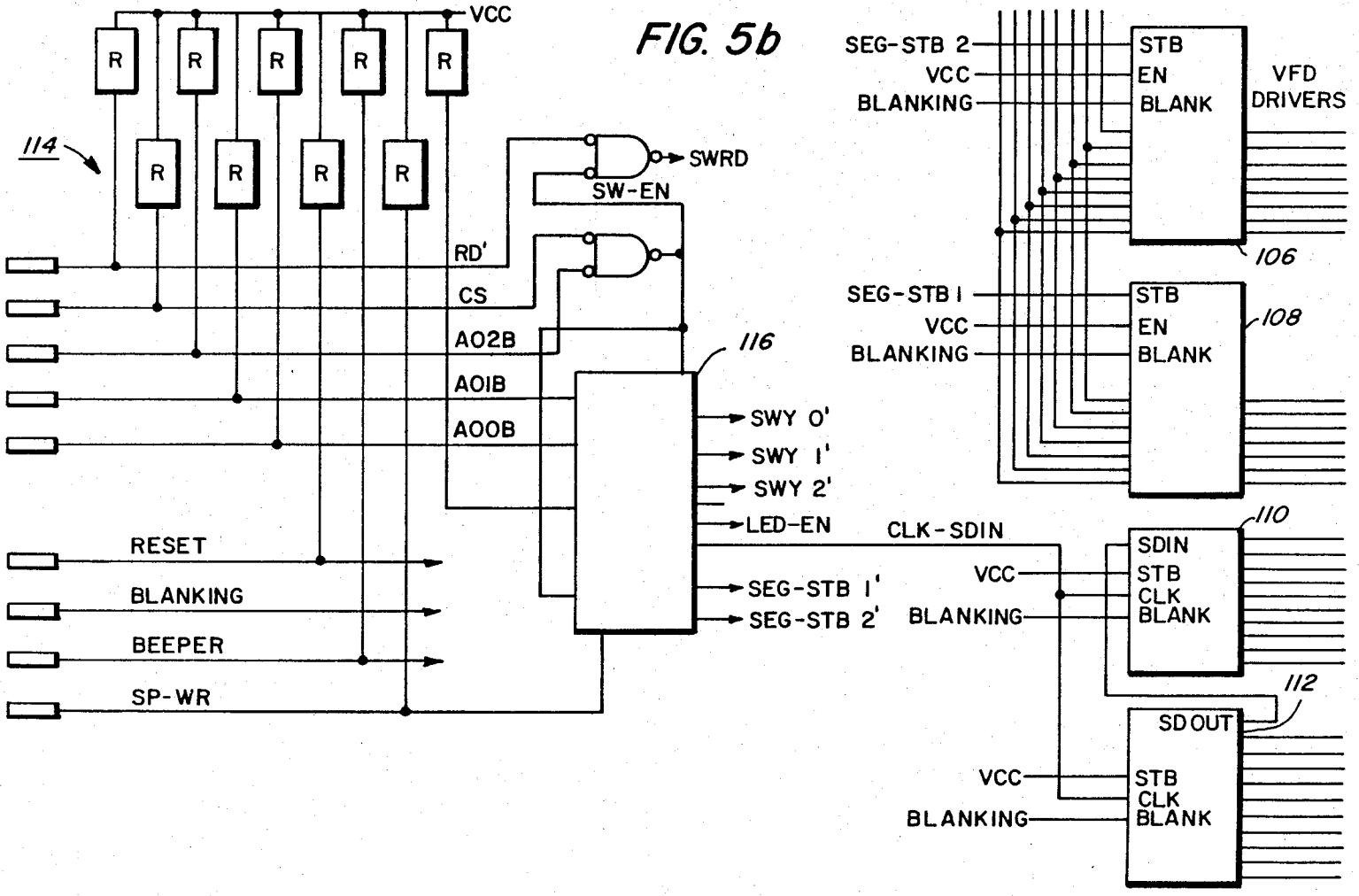
Figure 6:
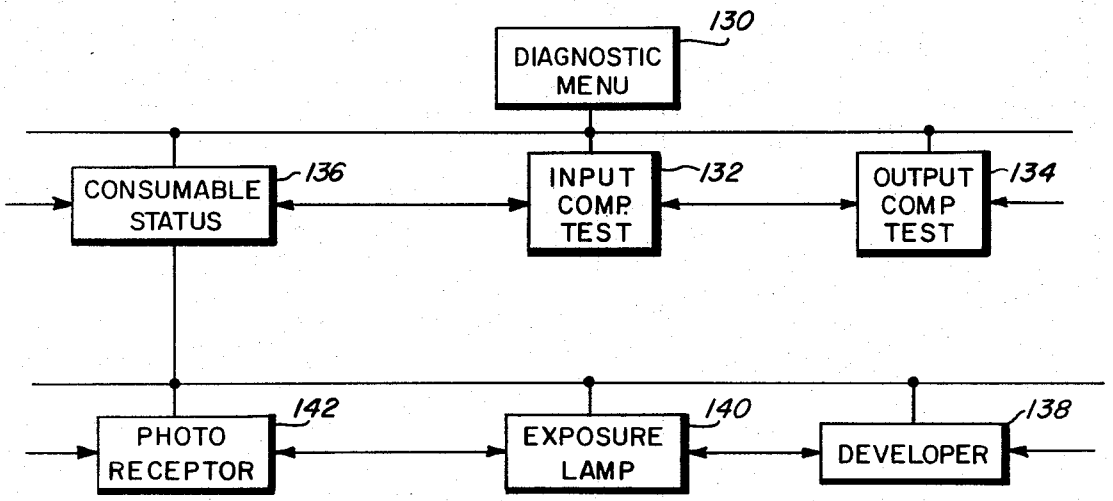

FIGS. 5*a* and 5*b* are a detailed schematic of the control panel board of the machine shown in FIG. 1; and FIG. 6 is an illustration of the scrolling procedure in accordance with the present invention.

Referring now to FIG. 1, there is shown by way of example, a reproduction machine 10 incorporating the present invention. In particular, the reproduction machine 10 includes an image recording drum-like member 12 having its outer periphery coated with a suitable photoconductive material. The drum rotates in the direction of the arrow to bring the image bearing surface past a plurality of xerographic processing stations.

Initially, the drum 12 moves the photoconductive surface through a charging station 14 providing an electrostatic charge uniformly over the photoconductive surface. Thereafter, the drum 12 is rotated to exposure station 16 and the charged photoconductive surface is exposed to a light image of the original document to be reproduced. After exposure drum 12 rotates the electrostatic latent image recorded on the photoconductive surface to development station 18 wherein a conventional developer mix is applied to the photoconductive surface of the drum 12 rendering the latent image visible. Typically, a suitable development station could include a magnetic brush development system utilizing a magnetizable developer mix having coarse ferromagnetic carrier granules and toner particles.

Sheets 20 of the copy paper are supported in a stack arrangement on elevating stack support trays 22. With a stack at its elevated position, a sheet separator 24 feeds individual sheets therefrom to the registration system 26. The sheet is then forwarded to the transfer station 28 in proper registration with the image on the drum. The developed image on the photoconductive surface 13 is brought into contact with the sheet 20. At transfer station 28, the toner image is transferred from the photoconductive surface to the contacting side of the copy sheet 20.

After the toner image has been transferred to the copy sheet 20, the copy sheet 20 with the image is advanced to a suitable fusing station 30 for coalescing the transferred powder image to the support material. After the fusing process, the copy sheet 20 is advanced to a suitable output device such as tray 32.

Residual toner particles remaining on the photoconductive surface 13 after the transfer operation are removed from the drum 12 as it moves through a cleaning station 32. Normally, when the copier is operated in a conventional mode, the original document to be reproduced is placed image side down upon a horizontal transparent platen 34 and the stationary original then scanned by means of a moving optical system. The scanning system includes a stationary lens 36 and a pair of cooperating movable scanning mirrors, half rate mirror 38 and full rate mirror 40 supported upon suitable carriages.

A document handler 42 can also be provided including pinch rolls 46 activated to feed a document around 180° curved guides into the platen 34 for copying. The document is driven by a platen belt transport including platen belt 48. After copying, the platen belt 48 is activated and the document is driven off the platen by the output pinch roll 50 into the document catch tray 52.

Figure 2:
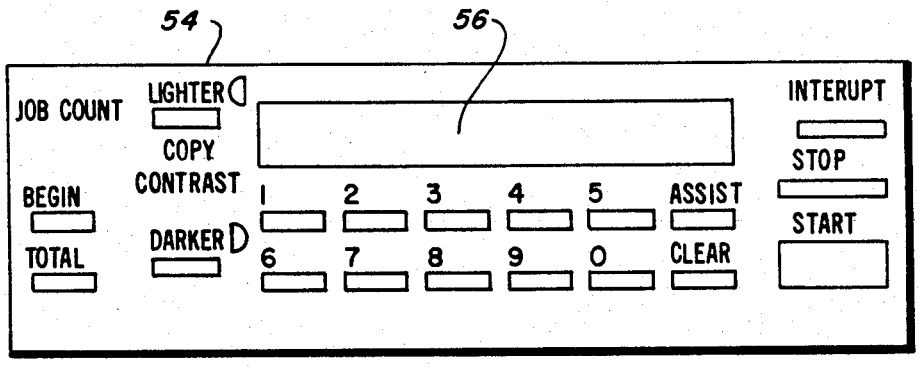
FIG. 2 is a top plan view of the operator console including display for assisting operator control of the machine according to the present invention.

With reference to FIG. 2, there is shown the operator control panel 54, in particular including a 20 character, 16 segment, alphanumeric display 56. The control panel 54 also includes 10 numeric keys and other switches such as start, stop, assist, clear, copy contrast, job count, the end, and total switches. In addition, there are switches for interrupt, copy lighter and copy darker with associated LED's.

Figure 3:
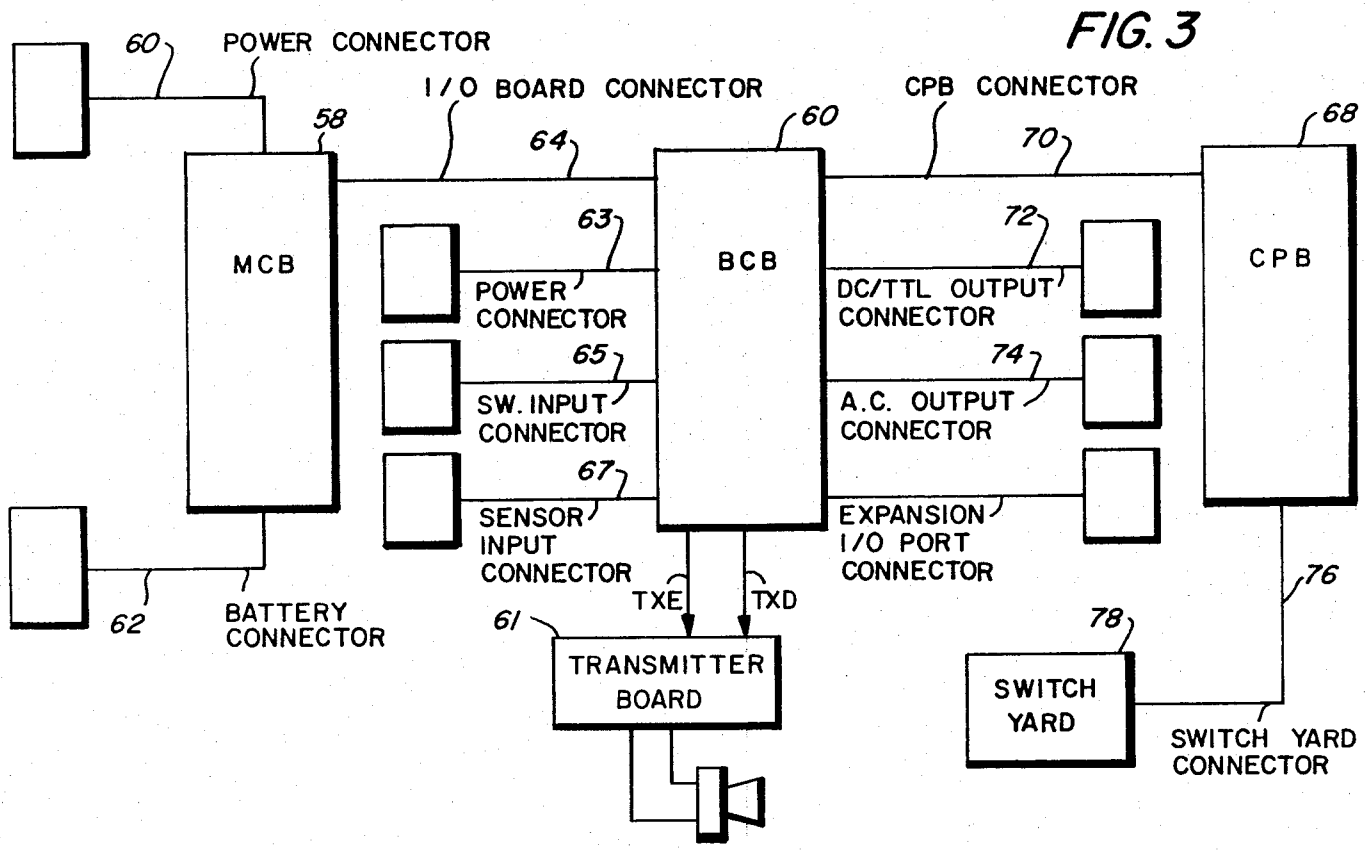
FIG. 3 is a general block diagram of the control of the machine illustrated in FIG. 1.

With reference to FIG. 3, there is shown a general block diagram of the control for the reproduction machine illustrated in FIG. 1. In particular, there is shown a master control board 58 interconnected to a power connector 60 and a battery connector 62. An I/O board connector 64 connects the master control board 58 to a base control board 60. The transmitter board 61 is connected to suitable accoustic lines for remote transmission of data contained in MCB 58. The base control board 60 is connected to a transmitter board 61 through a suitable modem connector, a power connector 63, a switch input connector 65 and a sensor input connector 67. The switch input connector 65 and sensor input connector 67 connect the base control board 60 to the various switches and sensors in the reproduction machine illustrated in FIG. 1 to receive inputs from the various switches and sensors. The base control board 60 is also interconnected to a control panel board 68 through a control panel board connector 70. The base control board 60 also provides outputs to the various components of the reproduction machine as shown in FIG. 1, through a DC output connector 72 and an AC output connector 74. The control panel board 68 is interconnected through a connector 76 to a switch yard or switch matrix 78 for receiving input from the operator control panel 54.

The master control board 58 is the central control for the machine. The base control board 60 is an extension of the master control using buffered address and data buses. The base control board 60 contains all the machine input buffers and output/driver triacs. The control panel board 68 is an extension of the base control board 60 to handle the control panel 54 input and output. It is interfaced by a buffered addressed/data bus, and the master control board 58 microprocessor will scan inputs and refresh the twenty character alphanumeric display 56 on the control panel 54.

Figure 4:
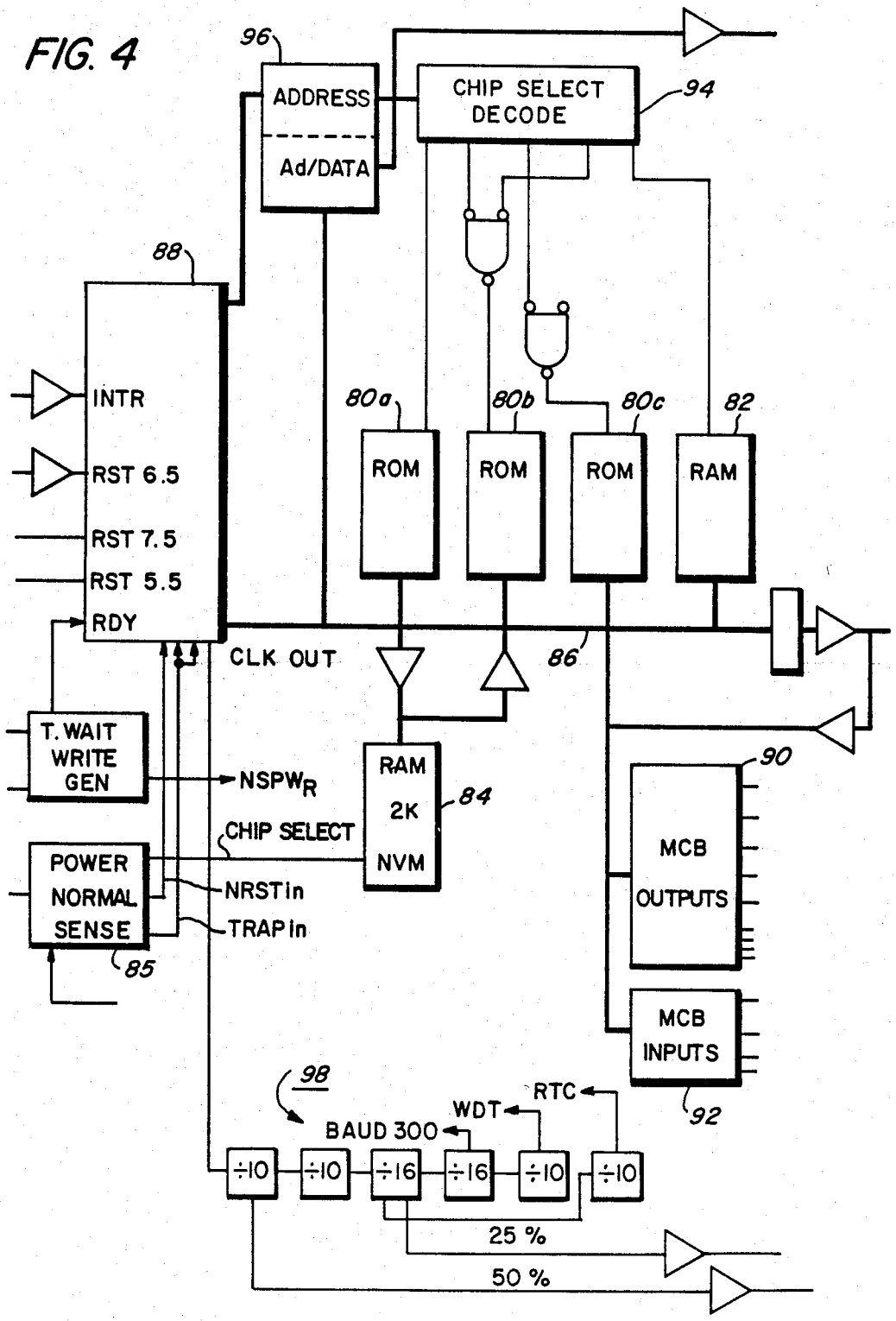
FIG. 4 is a detailed schematic of the master control board of the control of the present invention.

With reference to FIG. 4, the master control board 58 includes suitable ROM 80A, 80B, 80C, RAM 82 and nonvolatile NVM 84 memories. The memories are connected to a suitable internal bus 86, in turn connected to a microprocessor 88, preferably an Intel 8085. The bus 86 is preferably an eight bit bus, also interconnected to output logic 90 and input logic 92.

ROMS 80A and 80B contain the system operating instructions and the ROM 80C contains various message sets capable of being displayed on the display 56 to aid in the machine operation. The RAM 82 is any suitable read/write memory and the memories 80A, 80B, 80C and 82 are connected through suitable chip select decode circuitry 94 to address logic 96. The nonvolatile memory 84 is also interconnected to the bus 86 and to a suitable battery. Suitable support logic circuitry is generally shown at 98 and provides various signals such as 300 baud rate signal, i.e. WDT 34 millisecond signal, and a real time clock RTC 519 microsecond signal to provide the various timing signals for operation of the machine. The RTC signal and BAUD 300 signal provide interrupts to the master control board, in addition to zero cross interrupt.

The nonvolatile memory 84 contains information on the status of the machine. This information can be displayed on the twenty character display 56 on panel 54. A power normal sense detector 85 monitors decreases in power to initiate switching battery power to the non-volatile memory 84.

With reference to FIGS. 5*a* and 5*b* there is shown the control panel board in detail. In particular, the switch yard or matrix switch 78 is interconnected to the control panel board through a switch yard connector 76 and buffer 102. The switch yard 78 is preferably a three by eight switch matrix providing 19 switch functions. The buffer 102 is connected to an internal bus 104, the internal bus 104 in turn connected to the control panel board connector 70 as seen in FIG. 3.

Messages can be displayed on the alphanumeric display 56 in normal, marquee or in a scroll fashion. The type of message, whether normal, marquee or scroll, is identified by a code in front of the message. For example, the code ¶ 01 identifies a normal message. This code identifies just a single panel or short message that is displayed as a complete message. The code ¶ 02 identifies a message to be scrolled and the message is broken into its scrolled segments. Each segment is a given length up to 20 characters and is displayed a given length of time, for example, 500 milliseconds. After 500 milliseconds, the second character segment is displayed for 500 milliseconds.

An ¶ 03 code signifies the message to be marqueed. That is, a given number of characters, for example, the first 20 characters of the message are displayed. After a given period of time, for example 300 milliseconds, the message is shifted one character. The control will therefore display characters 2 through 21 of the message. This process will repeat, that is, characters 3 through 22, 4 through 23 . . . continually shifting and repeating the message. It should be noted that it is within the skill of the art to provide other codes for various display techniques. To display a message, the controller identifies the code and the type of message and then jumps to a specific routine to display the particular identified message in the correct fashion.

The instructions are stored in ROM memory 80C. Once the controller identifies that a certain message is to be displayed in a certain fashion, the message is conveyed from the ROM memory 80C to the control panel board 68 via the input/output board connector 64 and the CPB connector 70. The message is conveyed in the CPB 68 along the bus 104 to activate the drivers controlling the display 56. For further detail on the displaying of messages, reference is made to copending application Ser. No. 344,086, filed Jan. 29, 1982, and assigned to the same assignee as the present invention.

In accordance with the present inventon, a copy run update is provided on the status of consumable components in the reproduction machine such as the photoreceptor, developer, exposure lamp, cleaning blade, fuser rolls and feed rolls. In particular, a dedicated software counter corresponding to each of the consumables is provided in nonvolatile memory 84. Preferably, after completion of a copy run, each of the software counters is updated. That is, if ten copies have been produced, the photoreceptor software counter is incremented by 10, the exposure lamp software counter is incremented by 10, the fuser roll software counter is incremented by 10, and all the other software counters are appropriately incremented.

In a display mode, the content of any of these selected dedicated software counters can be displayed on the alphanumeric display 56. In particular, by keying in a suitable code at the control panel (CPB) 54, the contents of the particular software location in nonvolatile memory 84 are conveyed from the master control board 58 to the control panel board 68 by means of the input/output board connector 64 and the CPB connector 70. In the CPB 68, the contents are conveyed along bus 104 to activate the drivers controlling the display 56. After a component such as the photoreceptor has been replaced, the Tech Rep, through a suitable control procedure will reset the appropriate counter to 0.

Preferably, the display mode can be entered using a dedicated diagnostic button or switch or, as often the case, using a combination of existing keys on the control board 54. In a preferred embodiment, a diagnostic mode is entered and the first display in the diagnostic mode is a diagnostic menu. The diagnostic menu is merely a list of broad monitoring categories that are available. By activating a suitable switch such as the copy lighter or darker buttons on console 54, the system scrolls through the diagnostic menu, each selection of the menu sequentially displayed on the alphanumeric display 56. In other words, there are various stations and components of the reproduction machine that can be diagnosed.

TABLE I

| |
|---|
| Consumable Status |
| *Developer |
| *Drum |

TABLE I-continued

| |
|---|
| *Exposure Lamp |
| *Cleaning Blade |
| *Feed Rolls |
| Input Component Test |
| Registration Switch |
| Exit Roll Switch |
| By-pass Switch |
| Add Paper Switch |
| Paper Tray Interlock |
| Paper Size A Switch |
| Paper Size B Switch |
| Paper Size C Switch |
| Fuser Warm-up Thermostat |
| Platen Home Switch |
| Platen Registration Switch |
| Platen End of Scan Switch |
| Platen Dark Switch |
| Front Cover Interlock |
| Output Component Test |
| Exposure Lamp |
| By Pass Motor |
| Paper Feed Clutch |
| Feed Clutch & Motor |
| Paper Registration Clutch |
| Registration Clutch & Motor |
| Platen Left Clutch |
| Platen Left Clutch & Motor |
| Platen Right Clutch |
| Platen Right Clutch & Motor |
| Blade Solenoid |
| Dispenser Solenoid |
| Interdocument Erase Lamp |
| Edge Erase Lamp |

With reference to Table I, there are shown three broad categories for monitoring consumable status, input component test and output component test. It should be understood that other categories such as diagnostic routines, controller self checks and billing and copy credits could be provided. Each of these broad categories or stations are identified by a predetermined code.

After scrolling through the menu, it is necessary to key in from the console 54 the code identifying the general category to be monitored. Once the key corresponding to the general category to be monitored has been entered at the keyboard, the display can then be scrolled through the various subcomponents in that category. For example, with reference to Table I, the subcomponents of the input component test are listed such as registration switch, exit roll switch and by-pass switch. By again keying the copy lighter and darker switches, the display will scroll through the various input component test subcomponents.

In accordance with the present invention, with reference to FIG. 6, there is illustrated a hierarchy of diagnostic levels that are scrolled in monitoring consumable status. In particular, the block 130 diagnostic menu illustrates the step of placing the reproduction machine in a diagnostic state. Block 132 represents the input component test of the machine, block 134 represents the output component test, and block 136 represents the status of consumables. By activating the copy lighter/darker switches, the display is scrolled through these first high level categories. It should be understood that it is merely a matter of design choice how the various switches, sensors and other components of the machine are categorized for display and monitoring. By keying in the appropriate code from console 54, the monitoring system will drop to a second level of information. For example, assuming that the appropriate number to display consumable status has been entered, by the copy light or copy dark switch, the display will then scroll through the various consumables as illustrated by blocks 138, 140 and 142. If, for example, the display shows the photoreceptor, by entering a suitable code, the display will then show the contents of the counter corresponding to the photoreceptor.

Another feature of the present invention is to transmit the consumable status information shown on the alphanumeric display 56 to a remote station via the transmitter board 61 of FIG. 3. The machine transmits, via a telephone line, information such as the machine serial number and consumable status data as well as various other information such as billing meter and credit meter accounts. A suitable connector (not shown) links the machine control to a telephone line. In operation, with the connector attached, the machine will be precluded from operation in the print mode. In addition, the alphanumeric display will flag the operator that the connector must be unplugged before the print mode can be continued. This message preferably will appear when the start button is depressed and remain until the button is released.

During transmission of data, the display 56 will show for approximately 15 seconds the message and machine serial number. A message varying the accurate transmission of data, resend or disconnecting instructions will be provided at the machine through the connector. When the connector is unplugged, the control system will jump out of the transmit mode. If the connector is plugged in during the print mode, the machine will continue the job in progress but inhibit the start of the next job.

While there has been illustrated and described what is at present considered to be a preferred embodiment of the present invention, it will be appreciated that numerous changes and modifications are likely to occur to those skilled in the art and it is intended in the appended claims to cover all those changes and modifications which fall within the true spirit and scope of the present invention.

What is claimed is:

1. In a reproduction machine having a plurality of discrete operating components cooperable with one another to produce images on copy sheets and including an operator console having an alphanumeric display and a scrolling switch and a controller with a nonvolatile memory for storing indications of the operation of selected operating components, the operating components being grouped into categories, each category having subcomponents for monitoring, the method of monitoring the operation of a selected operating component including the steps of entering a display mode to display a diagnostic menu, scrolling the categories of reproduction machine components on the display in response to the activation of said scrolling switch, selecting a category of machine components, scrolling a set of subcomponents on the alphanumeric display within the said first selected category in response to the activation of said scrolling switch, and selecting one of said subcomponents for monitoring.

2. The method of claim 1 wherein the scrolling switch is a copy lighter/darker switch.

3. The method of claim 1 wherein the step of selecting a category includes the step of inputting a code from the operator console.

* * * * *